US009314099B2

(12) United States Patent
Huang et al.

(10) Patent No.: US 9,314,099 B2
(45) Date of Patent: Apr. 19, 2016

(54) MECHANICAL STRETCHING DEVICE OF CONVERTIBLE SOFA

(71) Applicant: Remacro Machinery & Technology (Wujiang) Co., Ltd., Suzhou (CN)

(72) Inventors: Xiaowei Huang, Suzhou (CN); Shunyun Qin, Suzhou (CN); Xiaohong Li, Suzhou (CN); Haibo Wang, Suzhou (CN); Guoli Zou, Suzhou (CN)

(73) Assignee: Remacro Machinery & Technology (Wujiang) Co., Ltd., Suzhou (CN)

( * ) Notice: Subject to any disclaimer, the term of this patent is extended or adjusted under 35 U.S.C. 154(b) by 0 days.

(21) Appl. No.: 13/880,933

(22) PCT Filed: Dec. 13, 2012

(86) PCT No.: PCT/CN2012/086546

§ 371 (c)(1),
(2) Date: Feb. 10, 2015

(87) PCT Pub. No.: WO2013/174128

PCT Pub. Date: Nov. 28, 2013

(65) Prior Publication Data

US 2015/0173511 A1 Jun. 25, 2015

(30) Foreign Application Priority Data

May 21, 2012 (CN) ..... 2012 1 0156865

(51) Int. Cl.
*A47C 1/031* (2006.01)
*A47C 1/0355* (2013.01)

(52) U.S. Cl.
CPC ..... *A47C 1/0355* (2013.01)

(58) Field of Classification Search
CPC .... A47C 1/034; A47C 1/0342; A47C 1/0345; A47C 1/0347; A47C 1/035; A47C 1/0352; A47C 1/0355
See application file for complete search history.

(56) References Cited

U.S. PATENT DOCUMENTS 4,878,710 A * 11/1989 Tacker ..... A47C 1/0355 297/68
5,087,094 A * 2/1992 Rogers, Jr. ..... A47C 1/0355 297/68

(Continued)

FOREIGN PATENT DOCUMENTS

CN 201571760 U 9/2010
CN 201977275 U 9/2011

(Continued)

*Primary Examiner* — Philip Gabler
(74) *Attorney, Agent, or Firm* — Hamre, Schumann, Mueller & Larson, P.C.

(57) ABSTRACT

A mechanical stretching device of a convertible sofa includes left components, right components, a switch component, and a locking spring. The left components are fixedly connected to the right components by fixing components. The switch component is mounted on the left components or on the right components. The left components and the right components respectively include a foot plate, a first foot lever, a second foot lever, a third foot lever, a fourth foot lever, a fifth foot lever, a side plate, a rotating shaft transmission member, a first connecting rod, a second connecting rod, a third connecting rod, a fourth connecting rod, a fifth connecting rod, a sixth connecting rod, a back member, a calf plate, a first support member, a second support member, a linkage member, a protective member, a seahorse member, and a bottom foot.

6 Claims, 11 Drawing Sheets

(56) References Cited

U.S. PATENT DOCUMENTS

| | | | | |
|---|---|---|---|---|
| 5,975,627 | A * | 11/1999 | LaPointe | A47C 1/0355 297/68 |
| 6,945,599 | B2 * | 9/2005 | May | A47C 3/027 297/270.1 |
| 7,147,278 | B2 * | 12/2006 | Johnson | A47C 1/0352 297/85 R |
| 7,396,074 | B2 * | 7/2008 | Wiecek | A47C 1/0355 297/68 |
| 7,497,512 | B2 * | 3/2009 | White | A47C 1/0355 297/85 R |
| 7,641,277 | B2 * | 1/2010 | Lawson | A47C 1/0355 297/85 L |
| 8,123,288 | B2 * | 2/2012 | Murphy | A47C 1/0355 297/85 M |

FOREIGN PATENT DOCUMENTS

| | | |
|---|---|---|
| CN | 202014873 | 10/2011 |
| CN | 202146108 U | 2/2012 |
| CN | 102657449 A | 9/2012 |
| CN | 202636249 U | 1/2013 |

* cited by examiner

MECHANICAL STRETCHING DEVICE OF CONVERTIBLE SOFA

BACKGROUND

1. Technical Field

The present invention relates to a sofa seat device, and more particularly to a mechanical stretching device of a multifunctional convertible sofa where a leg rest may be folded or unfolded, and an angle of a back may be adjusted.

2. Related Art

A current mechanical stretching device of a convertible sofa has five major defects: 1) a seat is generally high, so that during use by a user, feet do not touch the ground, which incurs feeling of fatigue to leg portions after a period of time, thereby affecting comfort of the sofa; 2) the seat, a back, and armrests are generally high, so that a developed functional sofa is too big, and therefore not in harmony with a home environment, thereby affecting development of appearance and use of the functional sofa; 3) the seat is high, so that application of a bottom connecting rod is inflexible, and the problem that the bottom connecting rod is exposed is incurred, thereby affecting the aesthetics of the appearance of the sofa, and lowering the grade of the sofa; 4) the seat is high, so that a cushion of the sofa is thin, thereby affecting comfort of the sofa; 5) the seat is high, and cannot be applied to a classic sofa with armrests touching the ground.

SUMMARY

The technical problem to be solved by the present invention is to eliminate defects in the prior art, so as to provide a mechanical stretching device of a convertible sofa that has a simple structure, makes use convenient, has the seat being lower than that of similar products, and has wider applications.

A technical solution adopted by the present invention to solve the problem is a mechanical stretching device of a convertible sofa, which includes left components and right components that are symmetrically disposed and fixedly connected to each other, where: the left components or the right components include a foot plate (15), a first foot lever (1), a second foot lever (14), a third foot lever (23), a fourth foot lever (3), a fifth foot lever (22), a side plate (9), a rotating shaft transmission member (4), a first connecting rod (16), a second connecting rod (20), a third connecting rod (12), a fourth connecting rod (21), a fifth connecting rod (26), a sixth connecting rod (25), a back member (8), a calf plate (2), a first support member (13), a second support member (10), a linkage member (18), a protective member (11), a seahorse member (19), and a bottom foot (17) that are linked to each other; one side of a first end of the back member (8) is rotatably connected to a first end of the side plate (9) by an eighth rotating shaft (37); the other side of the first end of the back member (8) is rotatably connected to a first end of the first connecting rod (16) by a twenty-ninth rotating shaft (58); the other end of the first connecting rod (16) is rotatably connected to one side of a first end of the linkage member (18) by a twenty-fourth rotating shaft (53); one side of a second end of the side plate (9) is rotatably connected to the fourth foot lever (3) by a fifth rotating shaft (34); a bottom portion, close to the second end, of the side plate (9) is rotatably connected to a first end of the fifth foot lever (22) by a sixth rotating shaft (35); one side, close to a middle portion, of the side plate (9) is rotatably connected to one side of a first end of the third connecting rod (12) by a twenty-seventh rotating shaft (56); the middle portion of the side plate (9) is rotatably connected to a first end of the seahorse member (19) by a twenty-sixth rotating shaft (55); one side, close to the first end, of the side plate (9) is rotatably connected to the other side of the first end of the linkage member (18) by a twenty-eighth rotating shaft (57); two ends of the protective member (11) are fixed on a top portion of the side plate (9) through screws; one side of a second end of the linkage member (18) is rotatably connected to a conveying end of the second support member (10) by a nineteenth rotating shaft (48); the other side of the second end of the linkage member (18) is rotatably connected to a first end of the second connecting rod (20) by a twenty-fifth rotating shaft (54); a bent end of the seahorse member (19) is rotatably connected to a first end of the fourth connecting rod (21) by a twentieth rotating shaft (49); a straight end of the seahorse member (19) is rotatably connected to a first end of the fifth connecting rod (26) by a seventeenth rotating shaft (46); the first end of the third connecting rod (12) is rotatably connected to a free end of the first support member (13) by a thirtieth rotating shaft (59); a turning end of the third connecting rod (12) is rotatably connected to the first end of the second connecting rod (20) and the side plate (9) by the twenty-seventh rotating shaft (56); the other end of the fourth connecting rod (21) is rotatably connected to a middle portion of the first support member (13) by a twenty-second rotating shaft 51; a fixed end of the first support member (13) and a fixed end of the second support member (10) are rotatably connected to the bottom foot (17) by a fifteenth rotating shaft (44) and a twenty-third rotating shaft (52) respectively; a position, close to the first end, on the fourth foot lever (3) is rotatably connected to a middle portion of the third foot lever (23) by a twelfth rotating shaft (41); the first end of the fourth foot lever (3) is rotatably connected to a first end of the first foot lever (1) by an eleventh rotating shaft (40); the first end of the fifth foot lever (22) is rotatably connected to a second end of the third foot lever (23) by a fourth rotating shaft (33); a middle portion of the fifth foot lever (22) is rotatably connected to a first end of the sixth connecting rod (25) by a thirteenth rotating shaft (42); a position, close to a second end, on the fifth foot lever (22) is rotatably connected to the first end of the fifth connecting rod (26) by a fourteenth rotating shaft (43); a first end of the third foot lever (23) is rotatably connected to a first end of the calf plate (2) by a third rotating shaft (32); a turning portion of the calf plate (2) is rotatably connected to a middle portion of the first foot lever (1) by a tenth rotating shaft (39); a second end of the first foot lever (1) is rotatably connected to a first end of the foot plate (15) by a second rotating shaft (31); a second end of the calf plate (2) is rotatably connected to a first end of the second foot lever (14) by a ninth rotating shaft (38); a second end of the second foot lever (14) is rotatably connected to a position, close to a first end, on the foot plate (15) by a first rotating shaft (30); the first end of the sixth connecting rod (25) is rotatably connected to a first end of the rotating shaft transmission member (4) by a sixteenth rotating shaft (45); a second end of the rotating shaft transmission member (4) is conveyably connected to the side plate (9) by a seventh rotating shaft (36); a first limiting bushing (71) is mounted on a position, between the first end and the turning end, of the third connecting rod (12); a second limiting bushing (72) is mounted on the second end of the rotating shaft transmission member (4), and is fit-mounted with the seventh rotating shaft (36); a third limiting bushing (73) and a fourth limiting bushing (74) are respectively mounted on one side of the second end of the linkage member (18); a fifth limiting bushing (75) is mounted on a position, close to a second end, on the fourth foot lever (3); a sixth limiting bushing (76) is mounted on a position, close to a second end, on the foot plate (15); a first limiting surface (60), a second limiting surface (61), and a limiting bridge (77) are disposed on the side plate (9); a third limiting surface (62) is disposed on the second support member (10); a fourth limiting surface (63) is disposed on the third connecting rod (12); a fifth limiting surface (64) is disposed on the second foot lever (14); a sixth limiting surface (65) is disposed on the fifth foot lever (22); a seventh limiting surface (66) is disposed on the third foot lever 23; an eighth limiting surface (67) is disposed on the sixth connecting rod (25); the first limiting bushing (71) is disposed to fit positions of the first limiting surface (60) and the sixth limiting surface (65); the second limiting bushing (72) is disposed to fit a position of the eighth limiting surface (67); the third limiting bushing (73) is fit-disposed with the second limiting surface (61); the fourth limiting bushing (74) is fit-disposed with the third limiting surface (62); the fifth limiting bushing (75) is fit-disposed with the seventh limiting surface (66); the sixth limiting bushing (76) is fit-disposed with the fifth limiting surface (64); the limiting bridge (77) is fit-disposed with the fourth limiting surface (63); the two locking springs (24) are symmetrically mounted between the side plate (9) and the sixth connecting rod (25) of the left components and between the side plate (9) and the sixth connecting rod (25) of the right components respectively.

One end of the locking spring (24) is mounted in a first locking spring mounting hole (68), the first locking spring mounting hole is also disposed on the side plate (9), a second locking spring mounting hole (69) is disposed on the sixth connecting rod (25), and the other end of the locking spring (24) is disposed in the second locking spring mounting hole (69).

The rotating shafts are all rivets.

A switch component mounted on the left components or on the right components is further included. The switch component includes a pulling cable rack (5), a pulling rope (6), and a pulling cable switch (7); the side plate (9) of the left components or of the right components is provided with a pulling cable mounting hole (70); the pulling cable rack (5) is mounted on the side plate (9); the pulling rope (6) is connected to the pulling cable switch (7) and the pulling cable rack (5) through the pulling cable mounting hole (70) on the side of the switch component; the rotating shaft transmission member (4) of the left components or of the right components is respectively connected to two ends of a rotating shaft tube member (78) symmetrically mounted on the side plate (9) of the left components and the side plate (9) of the right components; and the other end of the rotating shaft transmission member (4) is conveyably connected to the side plate (9) by the seventh rotating shaft (36).

The fixing components for fixedly connecting the left components to the right components include the rotating shaft tube member (78), a front balance tube (79), a front bottom connecting rod (80), an anti-twisting tube (81), a rear balance tube (82), and a rear bottom connecting rod (83); two ends of the front balance tube (79) are fixed on the first support member (13) of the left components and the first support member (13) of the right components respectively; two ends of the rear balance tube (82) are fixed on the second support member (10) of the left components and the second support member (10) of the right components respectively; two ends of the anti-twisting tube (81) are fixed on the linkage member (18) of the left components and the linkage member (18) of the right components respectively; two ends of the rotating shaft tube member (78) are fixed on the rotating shaft transmission member (4) of the left components and the rotating shaft transmission member (4) of the right components respectively; and two ends of the front bottom connecting rod (80) and two ends of the rear bottom connecting rod (83) are fixedly connected to front and rear ends of the bottom foot (17) of the left components and front and rear ends of the bottom foot (17) of the right components respectively.

The rotating shaft tube member (78), the front balance tube (79), the anti-twisting tube (81), the rear balance tube (82), and the front balance tube (79) among the fixing components are usually bolts.

Through the technical solution, the present invention has the following beneficial effects. The present invention decreases the height of the seat of the mechanical stretching device of the convertible sofa. The decrease of the height of the seat not only meets design requirements of a low-seat functional sofa, but also creates conditions for improving the thickness of the cushion and the comfort of sitting in regions where the seat is relatively high. The decrease of the height of the seat also creates extremely favorable conditions for developing models of the functional sofa, and makes the design of the height of the back and the height of the armrests more flexible.

In the present invention, the selection of the bottom connecting rod is more flexible. The seat of conventional products on the market is high, which limits the height of the bottom connecting rod, and the bottom connecting rod has to be directly placed on the floor, so that the bottom connecting rod is exposed, thereby affecting the appearance and grade of the sofa. According to the design of the bottom connecting rod attached to the present utility model patent, when the height is the same as that of the conventional products, the height of the foot cushion may be increased, and the bottom connecting rod may be less exposed, thereby improving the grade and value of the sofa.

As the present invention keeps the height of the conventional product, the patent may be connected to an H-shaped rack to achieve a function that the armrests touch the ground, and compared with the conventional product with the armrests touching the ground, the function that the armrests touch the ground in a leaning-against-no-wall case (that is, the unfolded sofa may lean against a wall, but the sofa may still be unfolded normally) may be achieved (the conventional product with the armrests touching the wall cannot achieve leaning-against-no-wall).

In the present invention, for the leg portion and foot portion parts (mainly the first support member, the second support member, the fourth foot lever, and the fifth foot lever), the length is shortened with the original width being kept, so as to improve the strength of the parts, and improve the overall performance and service life of the product, thereby improving the safety and grade of the sofa.

In the present invention, the travel for unfolding is substantially equal to that for closing (that is, during unfolding and closing, the distance between the turning position of the leg portion and the cushion of the sofa and the tail end of the leg portion is substantially unchanged), so as to reduce the phenomena that the soft pack is wrinkled after the sofa is unfolded and strained after the sofa is folded, and the problem that the opening is not smooth, thereby improving the functions and the appearance grade.

The present invention may be widely applied to multiple combined designs, such as designs of a single-seat sofa, a double-seat sofa, a trio-seat sofa, a theater sofa, and a corner sofa, and makes it convenient for a customer to develop a large number of new products by using a series of products.

The present invention is applicable to a manual manner or an electrical manner, and may apply manual control manners such as the round pulling cable type, the middle level pulling cable type, the handle-inbuilt type, and the handle-externally-disposed type, as well as motor-driven control.

The present invention may further be applied to functional design of a lift chair. Because the seat is lowered, the safety and grade of the sofa are improved.

In the present invention, the components, the connecting points, and the limits are re-designed, so as to lower the seat of the mechanical stretching device of the convertible sofa, so that the user can touch the ground with the feed when sitting, so as to prevent the legs from being fatigued, facilitate the development of the functions of the sofa, and enrich the types of the functional sofa, which has the lower seat and wider applications and is convenient and practical.

BRIEF DESCRIPTION OF THE DRAWINGS

The present disclosure will become more fully understood from the detailed description given herein below for illustration only, and thus are not limitative of the present disclosure, and wherein.

LIST OF REFERENCE NUMERALS

1—First foot lever, 2—Calf plate, 3—Fourth foot lever, 4—Rotating shaft transmission member, 5—Pulling cable rack, 6—Pulling rope, 7—Pulling cable switch, 8—Back member, 9—Side plate, 10—Second support member, 11—Protective member, 12—Third connecting rod, 13—First support member, 14—Second foot lever, 15—Foot plate, 16—First connecting rod, 17—Bottom foot, 18—Linkage member, 19—Seahorse member, 20—Second connecting rod, 21—Fourth connecting rod, 22—Fifth foot lever, 23—Third foot lever, 24—Locking spring, 25—Sixth connecting rod, 26—Fifth connecting rod, 27—First fixing hole, 28—Second fixing hole, 29—Third fixing hole, 30—First rotating shaft, 31—Second rotating shaft, 32—Third rotating shaft, 33—Fourth rotating shaft, 34—Fifth rotating shaft, 35—Sixth rotating shaft, 36—Seventh rotating shaft, 37—Eighth rotating shaft, 38—Ninth rotating shaft, 39—Tenth rotating shaft, 40—Eleventh rotating shaft, 41—Twelfth rotating shaft, 42—Thirteenth rotating shaft, 43—Fourteenth rotating shaft, 44—Fifteenth rotating shaft, 45—Sixteenth rotating shaft, 46—Seventeenth rotating shaft, 47—Rotating shaft, 48—Nineteenth rotating shaft, 49—Twentieth rotating shaft, 50—Twenty-first rotating shaft, 51—Twenty-second rotating shaft, 52—Twenty-third rotating shaft, 53—Twenty-fourth rotating shaft, 54—Twenty-fifth rotating shaft, 55—Twenty-sixth rotating shaft, 56—Twenty-seventh rotating shaft, 57—Twenty-eighth rotating shaft, 58—Twenty-ninth rotating shaft, 59—Thirtieth rotating shaft, 60—First limiting surface, 61—Second limiting surface, 62—Third limiting surface, 63—Fourth limiting surface, 64—Fifth limiting surface, 65—Sixth limiting surface, 66—Seventh limiting surface, 67—Eighth limiting surface, 68—First locking spring mounting hole, 69—Second locking spring mounting hole, 70—Pulling cable mounting hole, 71—First limiting bushing, 72—Second limiting bushing, 73—Third limiting bushing, 74—Fourth limiting bushing, 75—Fifth limiting bushing, 76—Sixth limiting bushing, 77—Limiting bridge, 78—Rotating shaft tube member, 79—Front balance tube, 80—Front bottom connecting rod, 81—Anti-twisting tube, 82—Rear balance tube, and 83—Rear bottom connecting rod.

DETAILED DESCRIPTION

The present invention is further illustrated below with reference to the accompanying drawings and embodiments.

Figure 1:
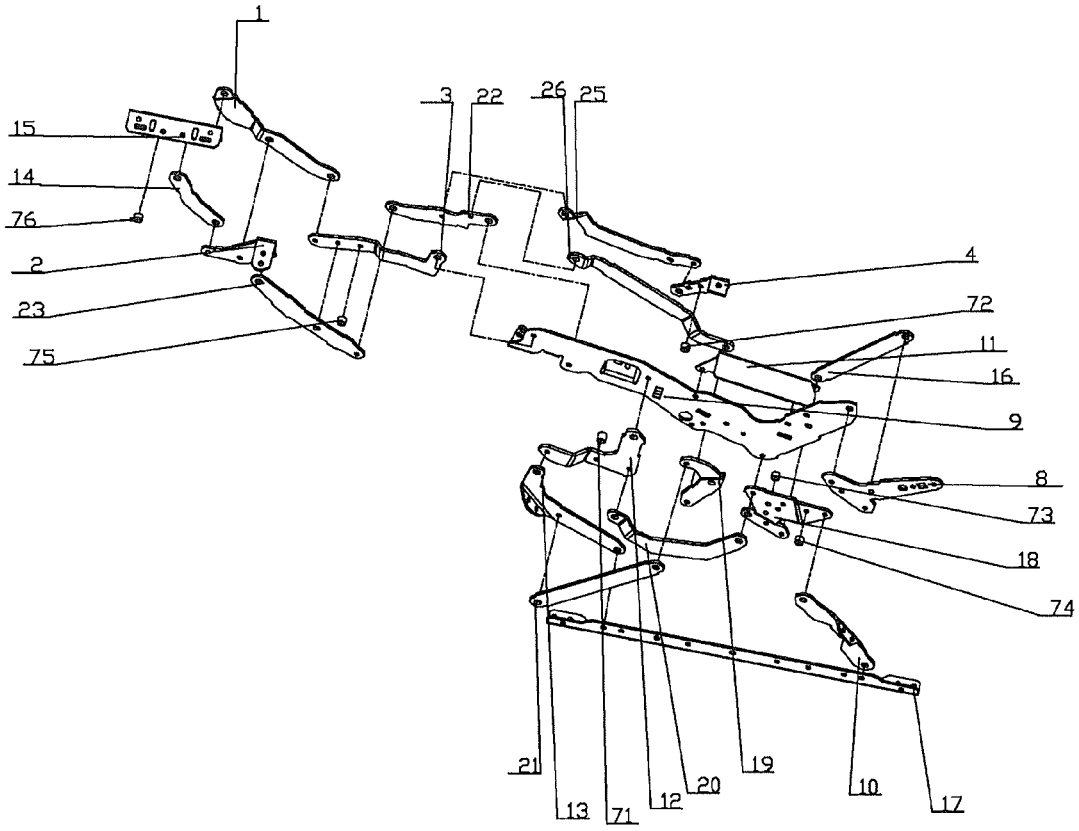
FIG. 1 is a three-dimensional assembly view of left components or right components of a mechanical stretching device of a convertible sofa according to the present invention.
Figure 2:
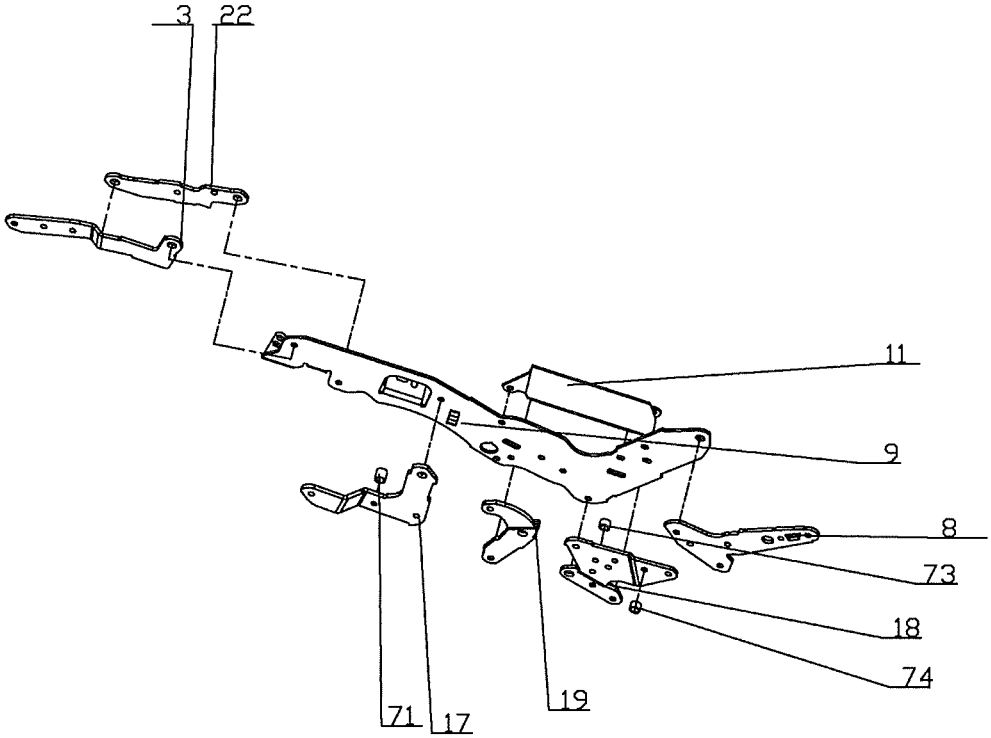
FIG. 2 is a three-dimensional assembly view of a side plate and components fit-disposed with the side plate of a mechanical stretching device of a convertible sofa according to the present invention.
Figure 3:
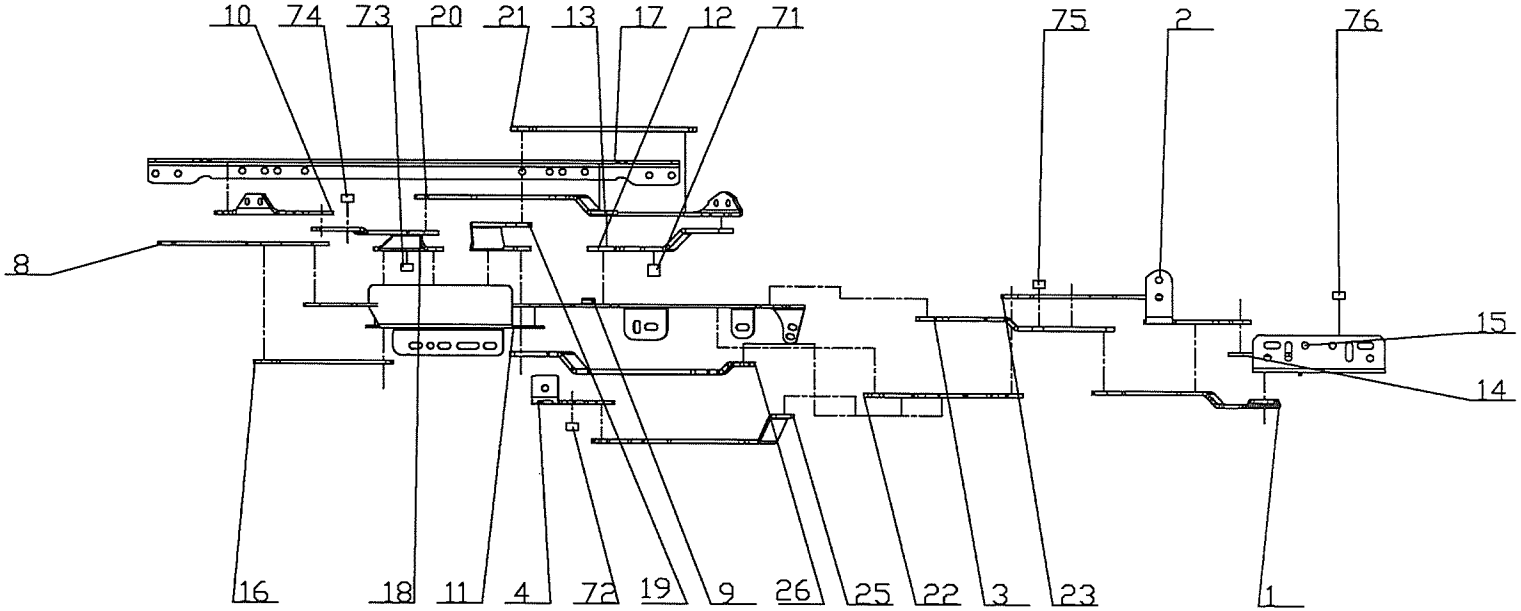
FIG. 3 is a two-dimensional assembly view of a mechanical stretching device of a convertible sofa according to the present invention.

As shown in FIG. 1 to FIG. 3, a mechanical stretching device of a convertible sofa in an embodiment includes left components, right components, a switch component, and a locking spring 24. The left components are fixedly connected to the right components by fixing components. The left components include a foot plate 15, a first foot lever 1, a second foot lever 14, a third foot lever 23, a fourth foot lever 3, a fifth foot lever 22, a side plate 9, a rotating shaft transmission member 4, a first connecting rod 16, a second connecting rod 20, a third connecting rod 12, a fourth connecting rod 21, a fifth connecting rod 26, a sixth connecting rod 25, a back member 8, a calf plate 2, a first support member 13, a second support member 10, a linkage member 18, a protective member 11, a seahorse member 19, and a bottom foot 17, which are the same as those included by the right components. One side of a first end of the back member 8 is rotatably connected to a first end of the side plate 9 by an eighth rotating shaft 37. The other side of the first end of the back member 8 is rotatably connected to a first end of the first connecting rod 16 by a twenty-ninth rotating shaft 58. The other end of the first connecting rod 16 is rotatably connected to one side of a first end of the linkage member 18 by a twenty-fourth rotating shaft 53. One side of a second end of the side plate 9 is rotatably connected to the fourth foot lever 3 by a fifth rotating shaft 34. A bottom portion, close to the second end, of the side plate 9 is rotatably connected to a first end of the fifth foot lever 22 by a sixth rotating shaft 35. One side, close to a middle portion, of the side plate 9 is rotatably connected to one side of a first end of the third connecting rod 12 by a twenty-seventh rotating shaft 56. The middle portion of the side plate 9 is rotatably connected to a first end of the seahorse member 19 by a twenty-sixth rotating shaft 55. One side, close to the first end, of the side plate 9 is rotatably connected to the other side of the first end of the linkage member 18 by a twenty-eighth rotating shaft 57. Two ends of the protective member 11 are fixed on a top portion of the side plate 9 through screws. One side of a second end of the linkage member 18 is rotatably connected to a conveying end of the second support member 10 by a nineteenth rotating shaft 48. The other side of the second end of the linkage member 18 is rotatably connected to a first end of the second connecting rod 20 by a twenty-fifth rotating shaft 54. A bent end of the seahorse member 19 is rotatably connected to a first end of the fourth connecting rod 21 by a twentieth rotating shaft 49. A straight end of the seahorse member 19 is rotatably connected to a first end of the fifth connecting rod 26 by a seventeenth rotating shaft 46. The first end of the third connecting rod 12 is rotatably connected to a free end of the first support member 13 by a thirtieth rotating shaft 59. A turning end of the third connecting rod 12 is rotatably connected to the first end of the second connecting rod 20 and the side plate 9 by the twenty-seventh rotating shaft 56. The other end of the fourth connecting rod 21 is rotatably connected to a middle portion of the first support member 13 by a twenty-second rotating shaft 51. A fixed end of the first support member 13 and a fixed end of the second support member 10 are rotatably connected to the bottom foot 17 by a fifteenth rotating shaft 44 and a twenty-third rotating shaft 52 respectively. A position, close to the first end, on the fourth foot lever 3 is rotatably connected to a middle portion of the third foot lever 23 by a twelfth rotating shaft 41. The first end of the fourth foot lever 3 is rotatably connected to a first end of the first foot lever 1 by an eleventh rotating shaft 40. The first end of the fifth foot lever 22 is rotatably connected to a second end of the third foot lever 23 by a fourth rotating shaft 33. A middle portion of the fifth foot lever 22 is rotatably connected to a first end of the sixth connecting rod 25 by a thirteenth rotating shaft 42. A position, close to a second end, on the fifth foot lever 22 is rotatably connected to the first end of the fifth connecting rod 26 by a fourteenth rotating shaft 43. A first end of the third foot lever 23 is rotatably connected to a first end of the calf plate 2 by a third rotating shaft 32. A turning portion of the calf plate 2 is rotatably connected to a middle portion of the first foot lever 1 by a tenth rotating shaft 39. A second end of the first foot lever 1 is rotatably connected to a first end of the foot plate 15 by a second rotating shaft 31. A second end of the calf plate 2 is rotatably connected to a first end of the second foot lever 14 by a ninth rotating shaft 38. A second end of the second foot lever 14 is rotatably connected to a position, close to a first end, on the foot plate 15 by a first rotating shaft 30. The first end of the sixth connecting rod 25 is rotatably connected to a first end of the rotating shaft transmission member 4 by a sixteenth rotating shaft 45. A second end of the rotating shaft transmission member 4 is conveyably connected to the side plate 9 by a seventh rotating shaft 36. A first limiting bushing 71 is mounted on a position, between the first end and the turning end, of the third connecting rod 12. A second limiting bushing 72 is mounted on the second end of the rotating shaft transmission member 4, and is fit-mounted with the seventh rotating shaft 36. A third limiting bushing 73 and a fourth limiting bushing 74 are respectively mounted on one side of the second end of the linkage member 18. A fifth limiting bushing 75 is mounted on a position, close to a second end, on the fourth foot lever 3. A sixth limiting bushing 76 is mounted on a position, close to a second end, on the foot plate 15. A first limiting surface 60, a second limiting surface 61, and a limiting bridge 77 are disposed on the side plate 9. A third limiting surface 62 is disposed on the second support member 10. A fourth limiting surface 63 is disposed on the third connecting rod 12. A fifth limiting surface 64 is disposed on the second foot lever 14. A sixth limiting surface 65 is disposed on the fifth foot lever 22. A seventh limiting surface 66 is disposed on the third foot lever 23. An eighth limiting surface 67 is disposed on the sixth connecting rod 25. The first limiting bushing 71 is disposed to fit positions of the first limiting surface 60 and the sixth limiting surface 65. The second limiting bushing 72 is disposed to fit a position of the eighth limiting surface 67. The third limiting bushing 73 is fit-disposed with the second limiting surface 61. The fourth limiting bushing 74 is fit-disposed with the third limiting surface 62. The fifth limiting bushing 75 is fit-disposed with the seventh limiting surface 66. The sixth limiting bushing 76 is fit-disposed with the fifth limiting surface 64. The limiting bridge 77 is fit-disposed with the fourth limiting surface 63. The two locking springs 24 are symmetrically mounted between the side plate 9 and the sixth connecting rod 25 of the left components and between the side plate 9 and the sixth connecting rod 25 of the right components respectively. In a specific mounting manner, a first locking spring mounting hole 68 is disposed on the side plate 9, a second locking spring mounting hole 69 is disposed on the sixth connecting rod 25, and two ends of the locking spring 24 are hung on the first locking spring mounting hole 68 and on the second locking spring mounting hole 69 respectively. The left components and the right components are symmetrical to each other, except the position where the switch component is mounted.

Figure 4:
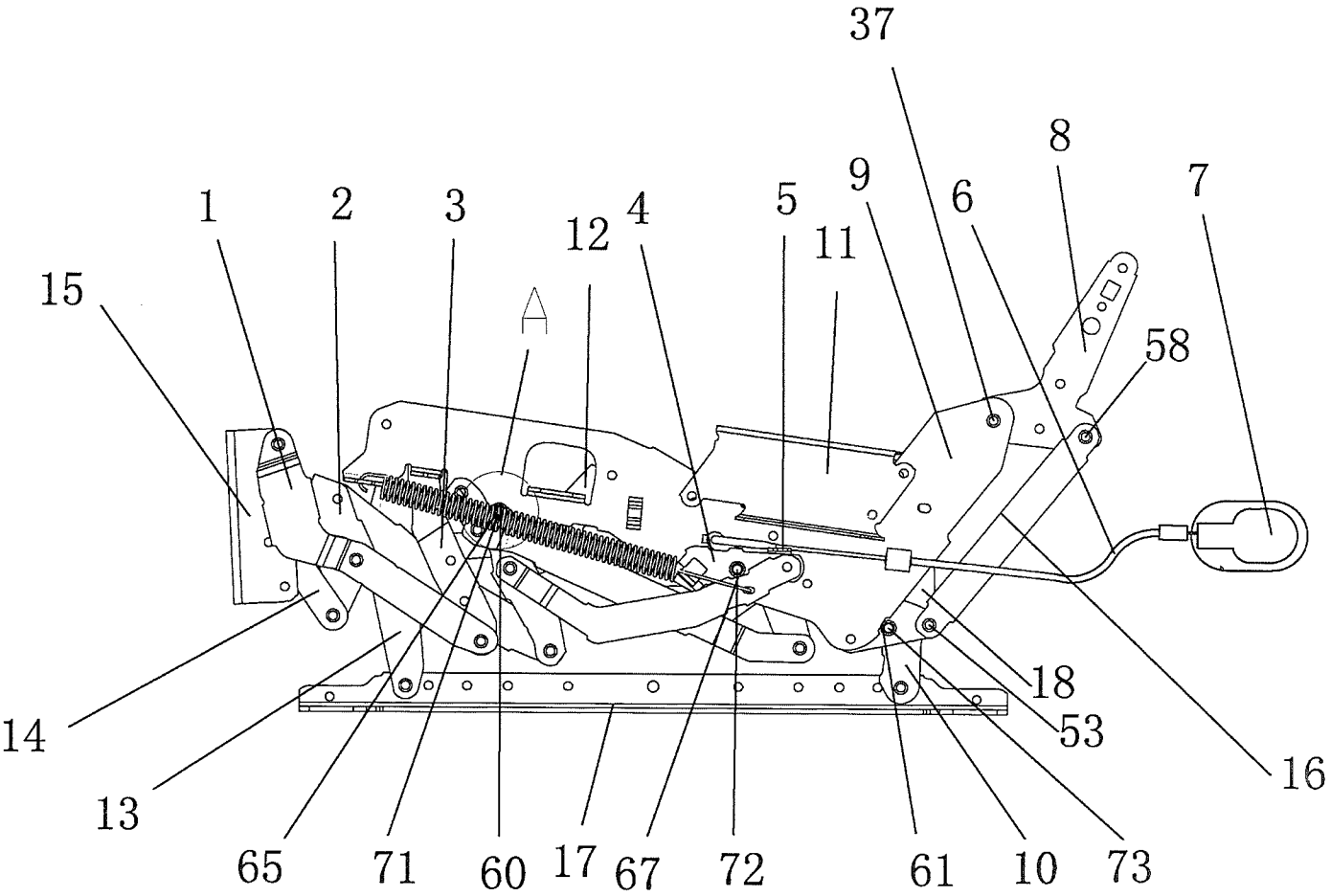
FIG. 4 is a schematic front view of left components or right components, when a leg portion is completely folded, of a mechanical stretching device of a convertible sofa according to the present invention.
Figure 9:
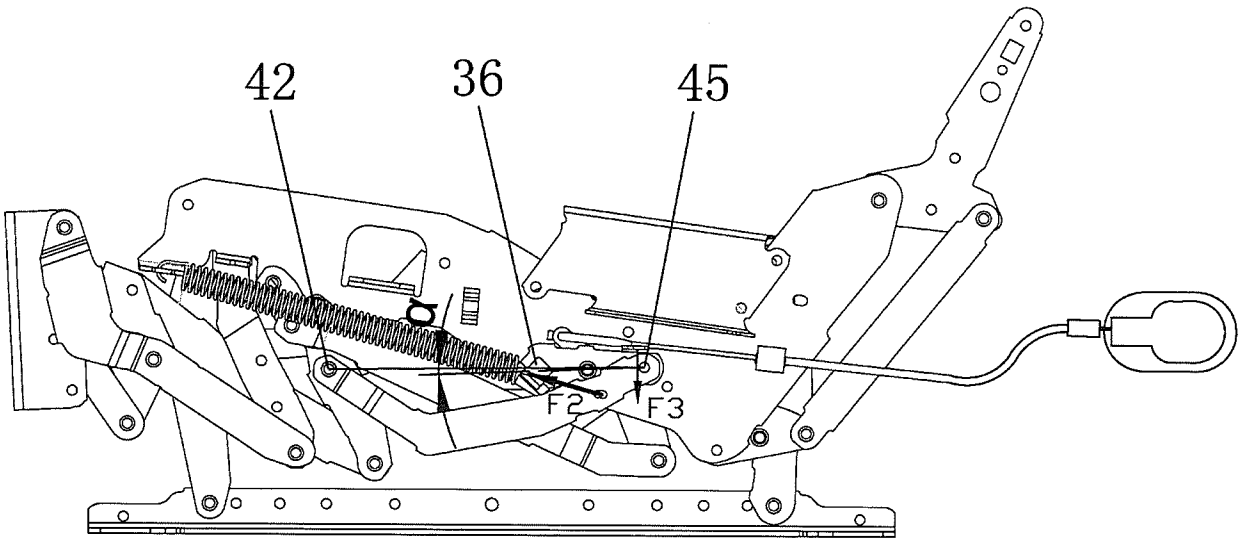
FIG. 9 is a schematic view of self-locking and unlocking of a mechanical stretching device of a convertible sofa according to the present invention.

As shown in FIG. 4 and FIG. 9, the switch component of this embodiment may be mounted on the left components or on the right components. The switch component includes a pulling cable rack 5, a pulling rope 6, and a pulling cable switch 7. The side plate 9 of the left components or of the right components is provided with a pulling cable mounting hole 70. The pulling cable rack 5 is mounted on the side plate 9. The pulling rope 6 is connected to the pulling cable switch 7 and the pulling cable rack 5 through the pulling cable mounting hole 70 on the side of the switch component. The rotating shaft transmission member 4 of the left components or of the right components is respectively connected to two ends of a rotating shaft tube member 78 symmetrically mounted on the side plate 9 of the left components and the side plate 9 of the right components. The other end of the rotating shaft transmission member 4 is conveyably connected to the side plate 9 by the seventh rotating shaft 36. When an included angle $\alpha$ between the thirteenth rotating shaft 42, the sixteenth rotating shaft 45, and the seventh rotating shaft 36 is 0 degrees (as shown in FIG. 9), that is, a distance between the thirteenth rotating shaft 42 and the sixteenth rotating shaft 45 is maximum, a inflection point is generated herein. When the sixth connecting rod 25 swings upwards to the eighth limiting surface 67 and is urged against the second limiting bushing 72, the locking spring 24 generates a pulling force F2 (as shown in FIG. 9), so that the mechanical stretching device of the convertible sofa performs self-locking to be in a locked state.

Figure 5:
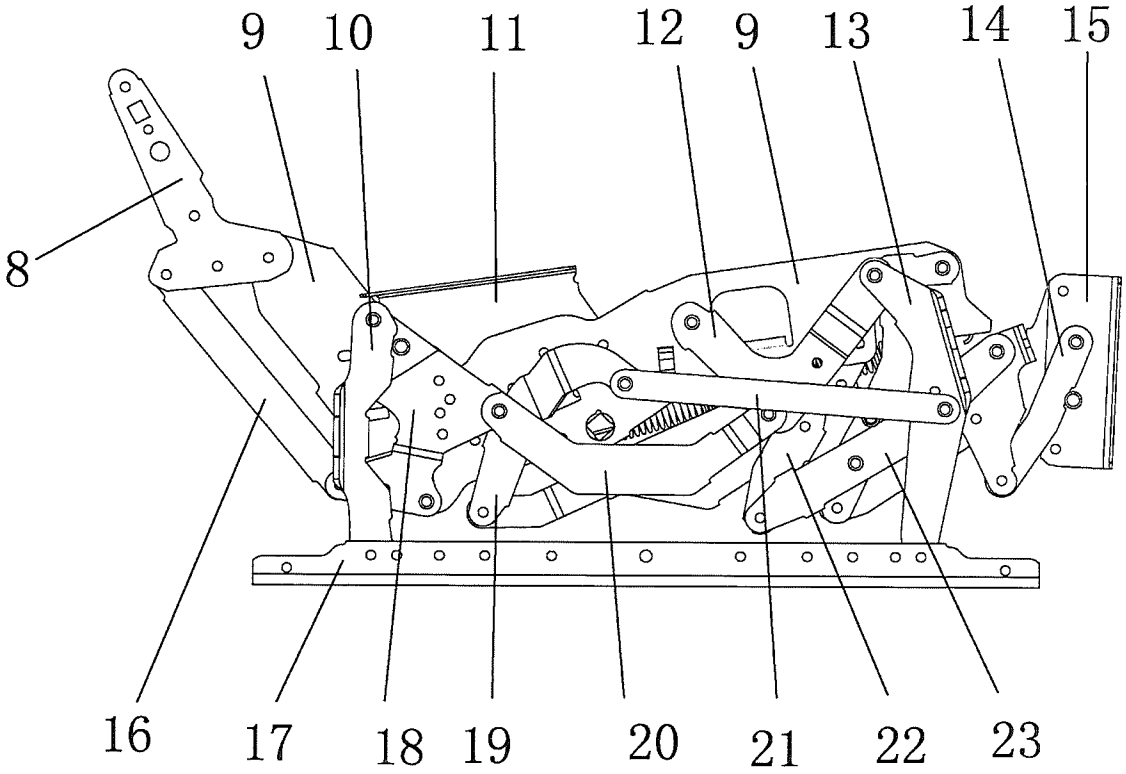
FIG. 5 is a rear view of FIG. 4.
Figure 6:
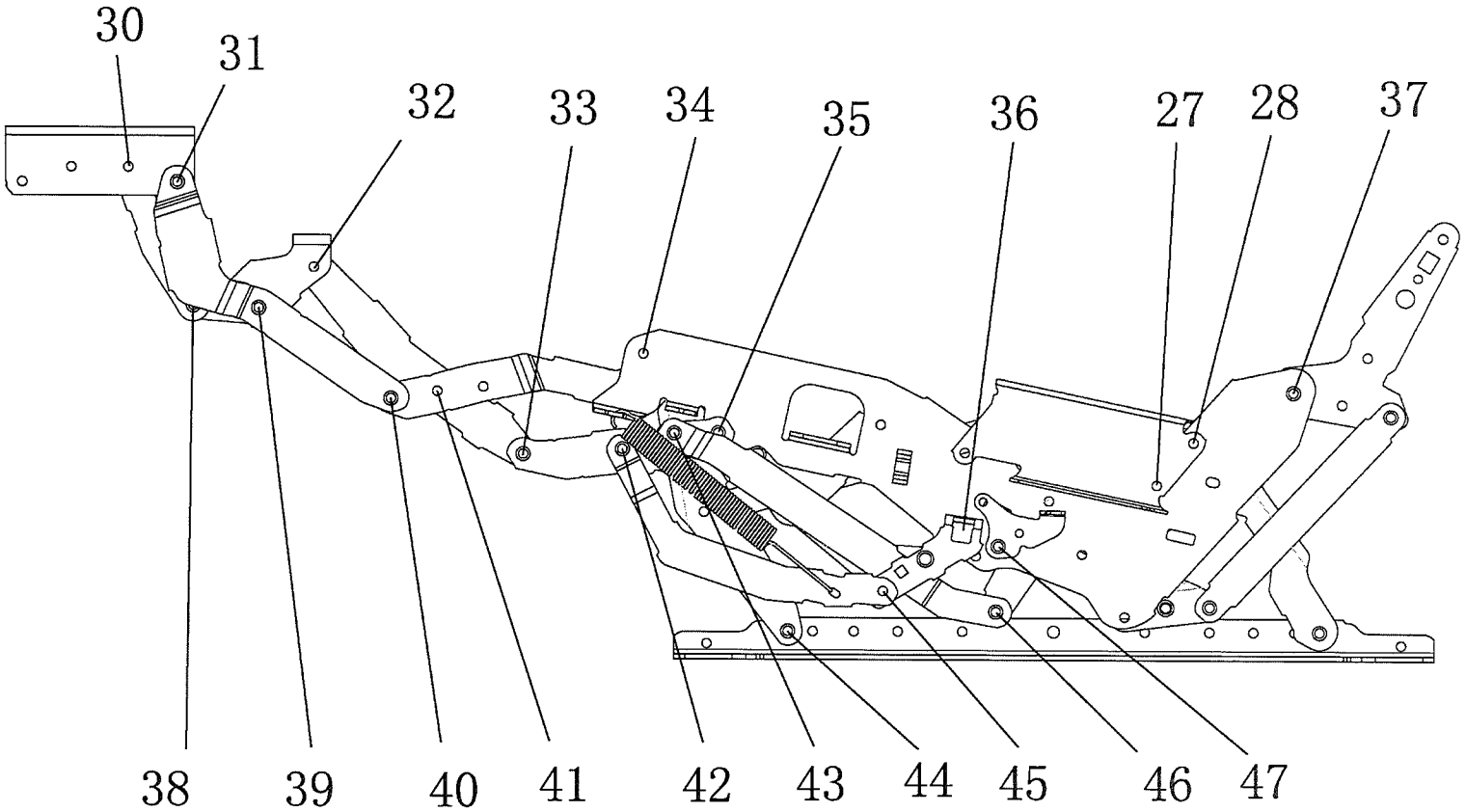
FIG. 6 is a schematic front view of left components or right components, when a leg portion is completely unfolded, of a mechanical stretching device of a convertible sofa according to the present invention.

Specifically, FIG. 5 to FIG. 6 illustrate a process in which the leg rest of the mechanical stretching device of the convertible sofa changes from being folded to being fully unfolded. Referring to FIG. 1 to FIG. 4, during use, a user gently pulls the pulling cable switch 7, so as to pull the pulling cable rack 5 through the pulling rope 6 connected to the pulling cable switch 7. The pulling cable rack 5 generates a downward reaction force F3 (as shown in FIG. 9) to move the rotating shaft transmission member 4 away. The second end of the rotating shaft transmission member 4 is conveyably connected to the side plate 9 by the seventh rotating shaft 36, meanwhile the first end of the sixth connecting rod 25 is rotatably connected to the first end of the rotating shaft transmission member 4 by the sixteenth rotating shaft 4, the middle portion of the fifth foot lever 22 is rotatably connected to the first end of the sixth connecting rod 25 by the thirteenth rotating shaft 42, the position, close to the second end, on the fifth foot lever 22 is rotatably connected to the first end of the fifth connecting rod 26 by the fourteenth rotating shaft 43, and the first end of the fifth foot lever 22 is rotatably connected to the second end of the third foot lever 23 by the fourth rotating shaft 33, so that the fifth foot lever 22 is rotatably connected to the third foot lever 23, the fifth connecting rod 26, and the side plate 9 by the fourth rotating shaft 33, the fourteenth rotating shaft 43, and the sixth rotating shaft 35 respectively; the third foot lever 23 is rotatably connected to the fourth foot lever 3 and the calf plate 2 by the twelfth rotating shaft 41 and the third rotating shaft 32 respectively; the fifth connecting rod 26 is rotatably connected to the seahorse member 19 by the seventeenth rotating shaft 46; the fourth foot lever 3 is rotatably connected to the first foot lever 1 and the side plate 9 by the eleventh rotating shaft 40 and the fifth rotating shaft 34 respectively; the calf plate 2 is rotatably connected to the second foot lever 14 and the first foot lever 1 by the ninth rotating shaft 38 and the tenth rotating shaft 39 respectively; the side plate 9 is rotatably connected to the back member 8, the first connecting rod 16, the seahorse member 19, and the linkage member 18 by the eighth rotating shaft 37, a twenty-first rotating shaft 50, the twenty-sixth rotating shaft 55, and the twenty-eighth rotating shaft 57 respectively; the back member 8 is rotatably connected to the first connecting rod 16 by the twenty-ninth rotating shaft 58; the first connecting rod 16 is rotatably connected to the second connecting rod 20 and the first support member 13 by the twenty-seventh rotating shaft 56 and the thirtieth rotating shaft 59 respectively; the linkage member 18 is rotatably connected to the first connecting rod 16, the second connecting rod 20, and the second support member 10 by the twenty-fourth rotating shaft 53, the twenty-fifth rotating shaft 54, and the nineteenth rotating shaft 48 respectively; the seahorse member 19 is rotatably connected to the fourth connecting rod 21 by the twentieth rotating shaft 49; and the bottom foot 17 is rotatably connected to the first support member 13 and the second support member 10 by the fifteenth rotating shaft 44 and the twenty-third rotating shaft 52 respectively. When the leg portion is in the folded state, the second limiting bushing 72 on the rotating shaft transmission member 4 is urged against the eighth limiting surface 67 on the sixth connecting rod 25, thereby achieving a locking and limiting effect. The third limiting bushing 73 and the fourth limiting bushing 74 on the linkage member 18 are urged against the second limiting surface 61 on the side plate 9 and the third limiting surface 62 on the second support member 10 respectively. The first limiting bushing 71 on the third connecting rod 12 is urged against the first limiting surface 60 on the side plate 9 and the sixth limiting surface 65 on the fifth foot lever 22 at the same time. The fifth limiting bushing 75 on the fourth foot lever 3 is urged against the seventh limiting surface 66 on the third foot lever 23. The sixth limiting bushing 76 on the foot plate 15 is urged against the fifth limiting surface 64 on the second foot lever 14. Therefore, the whole mechanical stretching device is in a locked state after being folded.

When another driving force exists, that is, generally the pulling cable rack 5 is pulled through the pulling cable switch 7 to generate a force F3 (as shown in FIG. 9) acting on the rotating shaft transmission member 4, the rotating shaft transmission member 4 rotates about the seventh rotating shaft 36, and therefore the rotating shaft transmission member 4 transmits the force to the sixth connecting rod 25 through the sixteenth rotating shaft 45 to produce a linked movement. The sixth connecting rod 25 makes, through the thirteenth rotating shaft 42, the fifth foot lever 22 rotate about the sixth rotating shaft 35 relatively. The fifth foot lever 22 drives, through the fourth rotating shaft 33, the third foot lever 23 to move. The third foot lever 23 makes, through the twelfth rotating shaft 41, the fourth foot lever 3 rotate about the fifth rotating shaft 34 relatively. The fourth foot lever 3 drives, through the eleventh rotating shaft 40, the first foot lever 1 to move. The first foot lever 1 and the third foot lever 23 drive, through the tenth rotating shaft 39 and the third rotating shaft 32, the calf plate 2 to rotate relatively. Then, the movement of the calf plate 2 drives, through the ninth rotating shaft 38, the second foot lever 14 to move. The first foot lever 1 and the second foot lever 14 drive, through the first rotating shaft 30 and the second rotating shaft 31, the foot plate 15 to rotate relatively. Therefore, the mechanical stretching device performs an overall stretching movement. When the fifth limiting bushing 75 on the fourth foot lever 3 is urged against the seventh limiting surface 66 on the third foot lever 23, a limiting effect is achieved, and the stretched state reaches a limit maximum position of stretching. In the aforementioned stretching process, the fifth foot lever 22 drives, through the fourteenth rotating shaft 43, the fifth connecting rod 26 to move in a linked manner; the fifth connecting rod 26 makes, through the seventeenth rotating shaft 46, the seahorse member 19 rotate about the twenty-sixth rotating shaft 55; the seahorse member 19, makes, through the twentieth rotating shaft 49, the fourth connecting rod 21 rotate about the twenty-second rotating shaft 51; the fourth connecting rod 21 drives, through the twenty-second rotating shaft 51, the first support member 13 to move in a linked manner through the fifteenth rotating shaft 44; the first support member 13 drives, through the thirtieth rotating shaft 59, the third connecting rod 12 to move in a linked manner; the third connecting rod 12 drives, through the twenty-seventh rotating shaft 56, the second connecting rod 20 to move in a linked manner; the second connecting rod 20 drives, through the twenty-fifth rotating shaft 54, the linkage member 18 to move in a linked manner; and the linkage member 18 derives, through the nineteenth rotating shaft. 48, the second support member 10 to move in a linked manner. In the process, the eighth rotating shaft 37, the twenty-ninth rotating shaft 58, the twenty-fourth rotating shaft 53, the twenty-eighth rotating shaft 57, the twenty-fifth rotating shaft 54, the twenty-seventh rotating shaft 56, and the twenty-first rotating shaft 50 between the back member 8, the side plate 9, the linkage member 18, the second connecting rod 20 and the first connecting rod 16 do not rotate relatively, so that the back member 8, the side plate 9, the first connecting rod 16, the linkage member 18, the second connecting rod 20, and the first connecting rod 16 are as a fixed whole in the stretching process of the mechanical stretching device.

Figure 7:
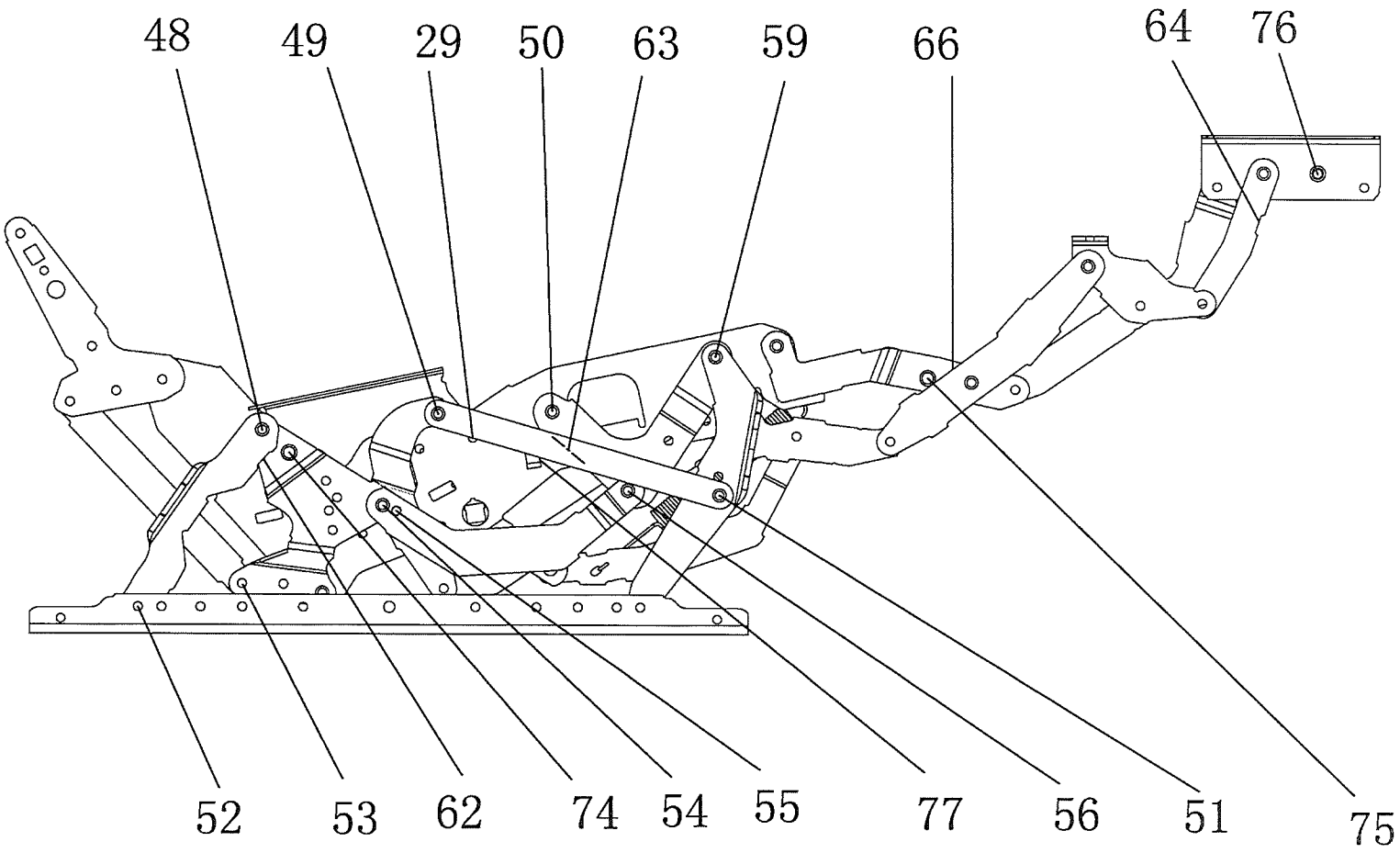
FIG. 7 is a rear view of FIG. 6.
Figure 8:
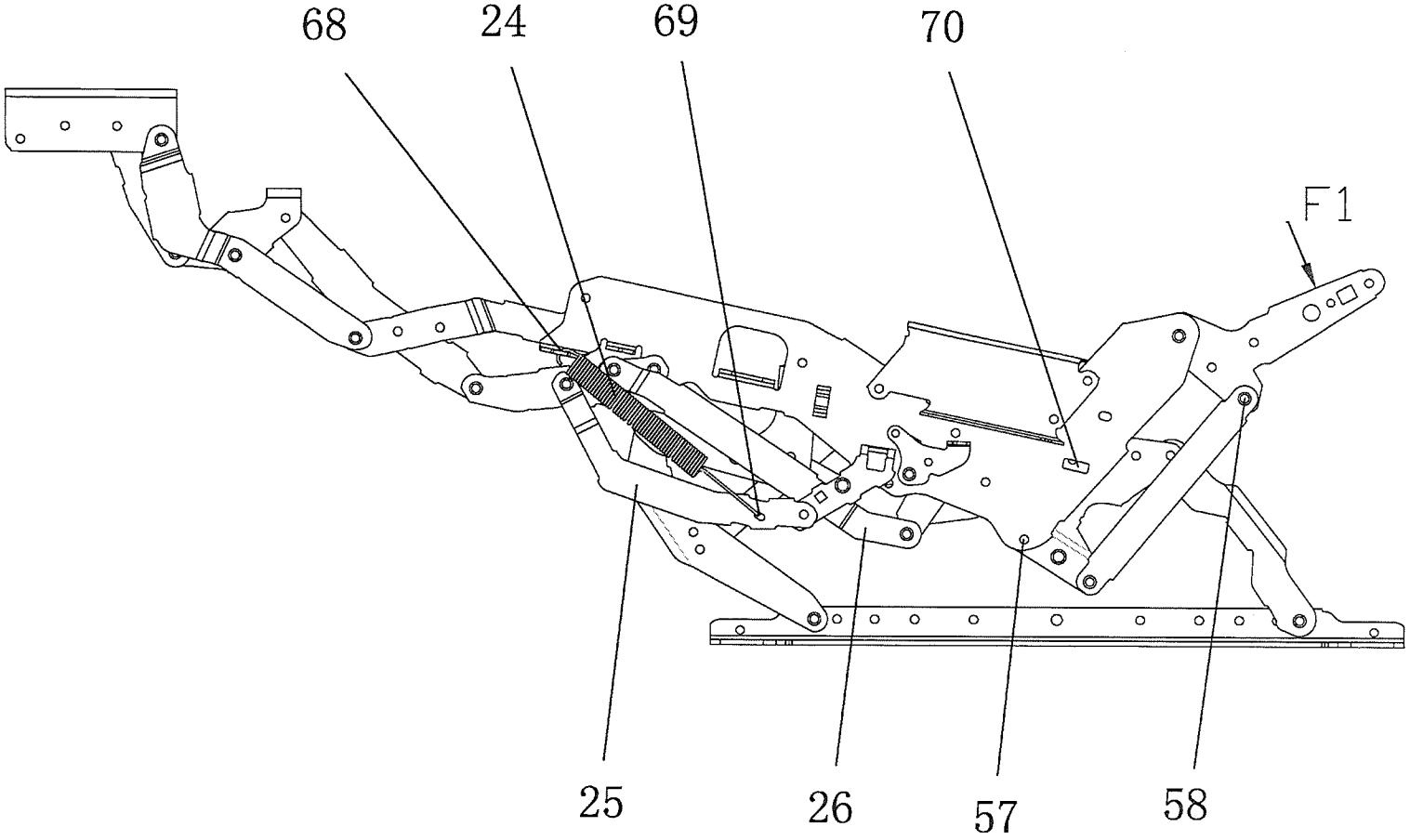
FIG. 8 is a schematic view of a fully inclined back of FIG. 6.

FIG. 7 to FIG. 8 illustrate the mechanical stretching device of the convertible sofa in a process from that the leg rest is fully unfolded to that the back is fully inclined. When a force F1 in a direction shown in the drawing is applied to the back member 8 (as shown in FIG. 8), generally through the gravity of the user, the back member 8 rotates about the eighth rotating shaft 37; the back member 8 is rotatably connected to the first connecting rod 16 by the twenty-ninth rotating shaft 58; the first connecting rod 16 drives, through the twenty-fourth rotating shaft 53, the linkage member 18 to rotate about the twenty-eighth rotating shaft 57; meanwhile, the linkage member 18 and the second support member 10 move in a linked manner through the nineteenth rotating shaft 48; the linkage member 18 drives the second connecting rod 20 to rotate about the twenty-seventh rotating shaft 56; the second connecting rod 20 drives, through the twenty-seventh rotating shaft 56, the third connecting rod 12 to move in a linked manner; the third connecting rod 12 rotates relative to the side plate 9 through the twenty-first rotating shaft 50; and the third connecting rod 12 drives, through the thirtieth rotating shaft 59, the first support member 13 to move forward around the fifteenth rotating shaft 44. In the process, the rotating shafts between the leg portion part, the side plate 9, the seahorse member 19, the second connecting rod 20, and the rotating shaft transmission member 4 do not move relatively. When the fourth limiting surface 63 on the third connecting rod 12 is urged against the limiting bridge 77 on the side plate 9, a limiting effect is achieved, so that the back is in a fully inclined state.

Figure 12:
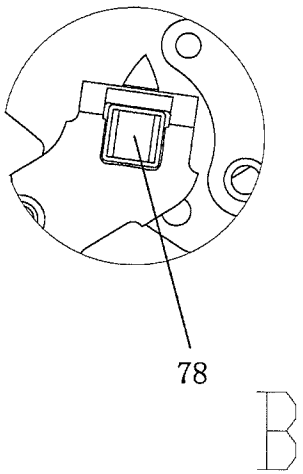
FIG. 12 is a schematic enlarged view of a position B in FIG. 11 of a mechanical stretching device of a convertible sofa according to the present invention.
Figure 10:
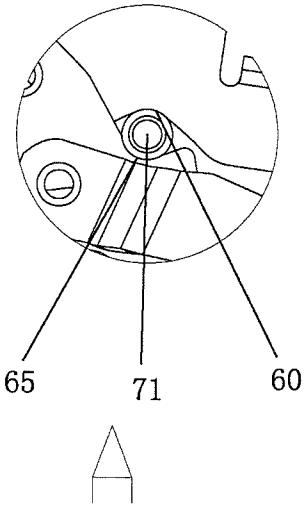
FIG. 10 is a schematic enlarged view of a position A in FIG. 4.
Figure 11:
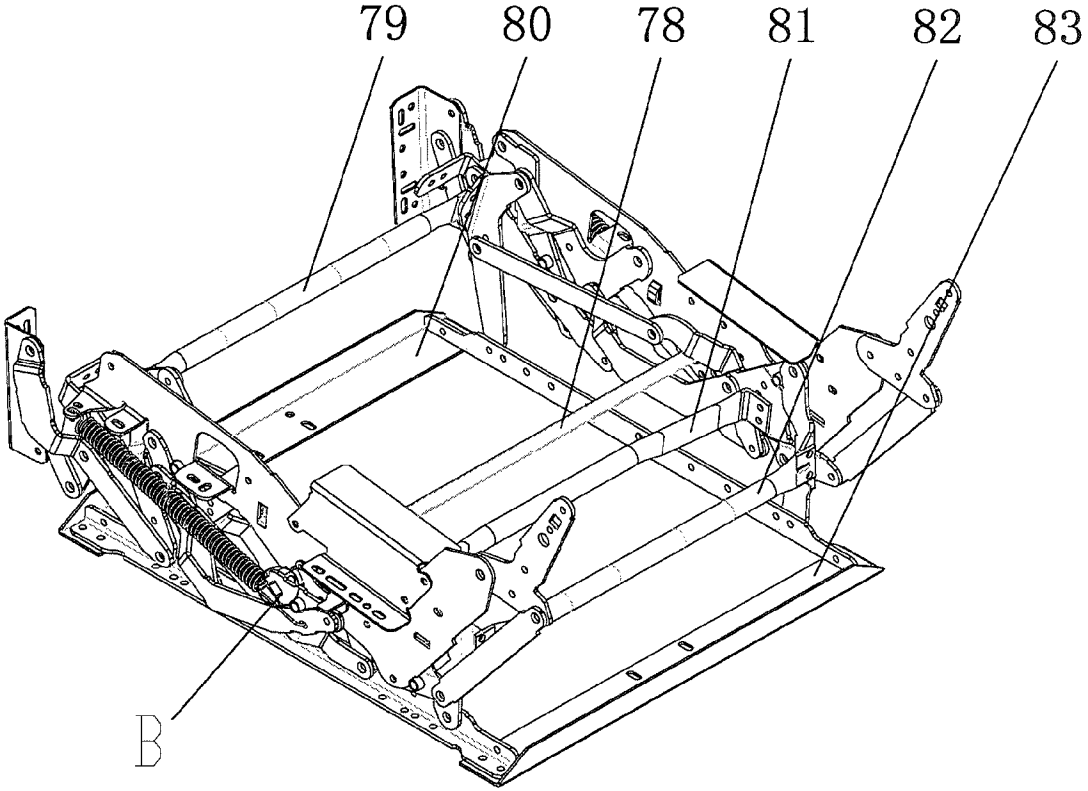
FIG. 11 is a schematic three-dimensional view of a mechanical stretching device of a convertible sofa, where left components are fixedly connected to right components by a tube member and a bottom connecting rod, according to the present invention.

As shown in FIG. 11 and FIG. 12, the fixing components for fixedly connecting the left components to the right components include the rotating shaft tube member 78, a front balance tube 79, a front bottom connecting rod 80, an anti-twisting tube 81, a rear balance tube 82, and a rear bottom connecting rod 83. Two ends of the front balance tube 79 are fixed on the first support member 13 of the left components and the first support member 13 of the right components respectively. Two ends of the rear balance tube 82 are fixed on the second support member 10 of the left components and the second support member 10 of the right components respectively. Two ends of the anti-twisting tube 81 are fixed on the linkage member 18 of the left components and the linkage member 18 of the right components respectively. Two ends of the rotating shaft tube member 78 are fixed on the rotating shaft transmission member 4 of the left components and the rotating shaft transmission member 4 of the right components respectively. Two ends of the front bottom connecting rod 80 and two ends of the rear bottom connecting rod 83 are fixedly connected to front and rear ends of the bottom foot 17 of the left components and front and rear ends of the bottom foot 17 of the right components respectively. Therefore, a complete mechanical stretching device of the convertible sofa is formed. The rotating shaft tube member 78, the front balance tube 79, the anti-twisting tube 81, the rear balance tube 82, and the front balance tube 79 among the fixing components are usually bolts.

Any simple variation or equivalent modification made to the present invention shall fall within the protection scope of the present invention.

What is claimed is:

1. A mechanical stretching device of a convertible sofa, comprising:

left components and right components that are symmetrically disposed and fixedly connected to each other, wherein: the left components and the right components each respectively comprise a foot plate, a first foot lever, a second foot lever, a third foot lever, a fourth foot lever, a fifth foot lever, a side plate, a rotating shaft transmission member, a first connecting rod, a second connecting rod, a third connecting rod, a fourth connecting rod, a fifth connecting rod, a sixth connecting rod, a back member, a calf plate, a first support member, a second support member, a linkage member, a protective member, a seahorse member, and a bottom foot that are linked to each other;

one side of a first end of the back member is rotatably connected to a first end of the side plate by an eighth rotating shaft;

the other side of the first end of the back member is rotatably connected to a first end of the first connecting rod by a twenty-ninth rotating shaft;

the other end of the first connecting rod is rotatably connected to one side of a first end of the linkage member by a twenty-fourth rotating shaft;

one side of a second end of the side plate is rotatably connected to the fourth foot lever by a fifth rotating shaft;

a bottom portion, close to the second end, of the side plate is rotatably connected to a first end of the fifth foot lever by a sixth rotating shaft;

one side, close to a middle portion, of the side plate is rotatably connected to one side of a first end of the third connecting rod by a twenty-seventh rotating shaft;

the middle portion of the side plate is rotatably connected to a first end of the seahorse member by a twenty-sixth rotating shaft;

one side, close to the first end, of the side plate is rotatably connected to the other side of the first end of the linkage member by a twenty-eighth rotating shaft;

two ends of the protective member are fixed on a top portion of the side plate through screws;

one side of a second end of the linkage member is rotatably connected to a conveying end of the second support member by a nineteenth rotating shaft;

the other side of the second end of the linkage member is rotatably connected to a first end of the second connecting rod by a twenty-fifth rotating shaft;

a bent end of the seahorse member is rotatably connected to a first end of the fourth connecting rod by a twentieth rotating shaft;

a straight end of the seahorse member is rotatably connected to a first end of the fifth connecting rod by a seventeenth rotating shaft;

the first end of the third connecting rod is rotatably connected to a free end of the first support member by a thirtieth rotating shaft;

a turning end of the third connecting rod is rotatably connected to the first end of the second connecting rod and the side plate by the twenty-seventh rotating shaft;

the other end of the fourth connecting rod is rotatably connected to a middle portion of the first support member by a twenty-second rotating shaft;

a fixed end of the first support member and a fixed end of the second support member are rotatably connected to the bottom foot by a fifteenth rotating shaft and a twenty-third rotating shaft respectively;

a position, close to the first end, on the fourth foot lever is rotatably connected to a middle portion of the third foot lever by a twelfth rotating shaft;

the first end of the fourth foot lever is rotatably connected to a first end of the first foot lever by an eleventh rotating shaft;

the first end of the fifth foot lever is rotatably connected to a second end of the third foot lever by a fourth rotating shaft;

a middle portion of the fifth foot lever is rotatably connected to a first end of the sixth connecting rod by a thirteenth rotating shaft;

a position, close to a second end, on the fifth foot lever is rotatably connected to the first end of the fifth connecting rod by a fourteenth rotating shaft;

a first end of the third foot lever is rotatably connected to a first end of the calf plate by a third rotating shaft;

a turning portion of the calf plate is rotatably connected to a middle portion of the first foot lever by a tenth rotating shaft;

a second end of the first foot lever is rotatably connected to a first end of the foot plate by a second rotating shaft;

a second end of the calf plate is rotatably connected to a first end of the second foot lever by a ninth rotating shaft;

a second end of the second foot lever is rotatably connected to a position, close to a first end, on the foot plate by a first rotating shaft;

the first end of the sixth connecting rod is rotatably connected to a first end of the rotating shaft transmission member by a sixteenth rotating shaft;

a second end of the rotating shaft transmission member is conveyably connected to the side plate by a seventh rotating shaft;

a first limiting bushing is mounted on a position, between the first end and the turning end, of the third connecting rod;

a second limiting bushing is mounted on the second end of the rotating shaft transmission member, and is fit-mounted with the seventh rotating shaft;

a third limiting bushing and a fourth limiting bushing are respectively mounted on one side of the second end of the linkage member;

a fifth limiting bushing is mounted on a position, close to a second end, on the fourth foot lever;

a sixth limiting bushing is mounted on a position, close to a second end, on the foot plate;

a first limiting surface, a second limiting surface, and a limiting bridge are disposed on the side plate;

a third limiting surface is disposed on the second support member;

a fourth limiting surface is disposed on the third connecting rod;

a fifth limiting surface is disposed on the second foot lever;

a sixth limiting surface is disposed on the fifth foot lever;

a seventh limiting surface is disposed on the third foot lever;

an eighth limiting surface is disposed on the sixth connecting rod;

the first limiting bushing is disposed to fit positions of the first limiting surface and the sixth limiting surface;

the second limiting bushing is disposed to fit a position of the eighth limiting surface;

the third limiting bushing is fit-disposed with the second limiting surface;

the fourth limiting bushing is fit-disposed with the third limiting surface;

the fifth limiting bushing is fit-disposed with the seventh limiting surface;

the sixth limiting bushing is fit-disposed with the fifth limiting surface;

the limiting bridge is fit-disposed with the fourth limiting surface; and two locking springs are symmetrically mounted between the side plate and the sixth connecting rod of the left components and between the side plate and the sixth connecting rod of the right components respectively.

2. The mechanical stretching device of a convertible sofa according to claim 1, wherein one end of the respective locking springs is mounted in a first locking spring mounting hole, the first locking spring mounting hole is also disposed on the side plate, a second locking spring mounting hole is disposed on the sixth connecting rod, and the other end of the respective locking springs is disposed in the second locking spring mounting hole.

3. The mechanical stretching device of a convertible sofa according to claim 2, wherein the rotating shafts are all rivets.

4. The mechanical stretching device of a convertible sofa according to claim 1, further comprising:

a switch component mounted on the left components or on the right components, wherein the switch component comprises a pulling cable rack, a pulling rope, and a pulling cable switch;

the side plate of the left components or of the right components is provided with a pulling cable mounting hole;

the pulling cable rack is mounted on the side plate;

the pulling rope is connected to the pulling cable switch and the pulling cable rack through the pulling cable mounting hole on the side of the switch component;

the rotating shaft transmission member of the left components or of the right components is respectively connected to two ends of a rotating shaft tube member symmetrically mounted on the side plate of the left components and the side plate of the right components; and the other end of the rotating shaft transmission member is conveyably connected to the side plate by the seventh rotating shaft.

5. The mechanical stretching device of a convertible sofa according to claim 1, wherein fixing components for fixedly connecting the left components to the right components comprise:

a rotating shaft tube member, a front balance tube, a front bottom connecting rod, an anti-twisting tube, a rear balance tube, and a rear bottom connecting rod;

two ends of the front balance tube are fixed on the first support member of the left components and the first support member of the right components respectively;

two ends of the rear balance tube are fixed on the second support member of the left components and the second support member of the right components respectively;

two ends of the anti-twisting tube are fixed on the linkage member of the left components and the linkage member of the right components respectively;

two ends of the rotating shaft tube member are fixed on the rotating shaft transmission member of the left components and the rotating shaft transmission member of the right components respectively; and two ends of the front bottom connecting rod and two ends of the rear bottom connecting rod are fixedly connected to front and rear ends of the bottom foot of the left components and front and rear ends of the bottom foot of the right components respectively.

6. The mechanical stretching device of a convertible sofa according to claim 5, wherein the rotating shaft tube member, the front balance tube, the anti-twisting tube, the rear balance tube, and the front balance tube among the fixing components are bolts.

* * * * *